US006454612B1

(12) United States Patent
Wang

(10) Patent No.: US 6,454,612 B1
(45) Date of Patent: Sep. 24, 2002

(54) WALL PLUG

(76) Inventor: Ming-Shan Wang, No. 5, Alley 4, Lane 108, Tsung Hsing St., Taipei City (TW)

( * ) Notice: Subject to any disclaimer, the term of this patent is extended or adjusted under 35 U.S.C. 154(b) by 0 days.

(21) Appl. No.: 09/946,351

(22) Filed: Sep. 6, 2001

(51) Int. Cl.[7] ..... H01R 13/04
(52) U.S. Cl. ..... 439/694; 439/106
(58) Field of Search ..... 439/106, 466, 439/468, 686, 689, 599, 694, 731

(56) References Cited

U.S. PATENT DOCUMENTS 3,787,798 A * 1/1974 Carissimi et al. ..... 439/466
3,850,496 A * 11/1974 Hague ..... 439/685
4,927,376 A * 5/1990 Dickie ..... 439/484
5,295,859 A * 3/1994 Kawai et al. ..... 439/455
5,662,491 A * 9/1997 Antilla et al. ..... 439/342
6,089,924 A * 7/2000 Wang ..... 439/694
6,250,952 B1 * 6/2001 Shiga et al. ..... 439/466
6,267,627 B1 * 7/2001 Lin ..... 439/622
6,290,533 B1 * 9/2001 Major ..... 439/490

* cited by examiner

*Primary Examiner*—Brian Sircus
*Assistant Examiner*—Thanh-Tam Le
(74) *Attorney, Agent, or Firm*—Rosenberg, Klein & Lee

(57) ABSTRACT

The present invention relates to a wall plug which includes a housing and a cover. The housing has the full height of the plug body and includes concave surfaces at the outer side thereof. The cover is engaged into the opening of the housing and fixed therein so that the housing encloses the cover. Accordingly, the assembly is made more easily, the strength is intensified and the wall plug is easily removed from the wall socket.

2 Claims, 6 Drawing Sheets

WALL PLUG

BACKGROUND OF THE INVENTION

1. Field of the Invention

The present invention relates to a wall plug, and more particularly, to a wall plug made by nonplastic injection molding and consisting of a housing and a cover both of which are combined while the housing encloses the cover. Accordingly, the assembly is made more easily, the strength is intensified and the wall plug is easily removed from the wall socket.

2. Description of the Prior Art

The blades 11 and the main body 12 of a conventional wall plug, as shown in FIG. 1, are disposed in the same direction so that the main body 12 projects from the wall socket to occupy unnecessary room. In order to remove the above-mentioned drawback, a wall plug (see FIG. 2) is developed and features the vertical arrangement of the blades 21 to the main body 22. Thus, when the blades 21 are inserted into the wall socket, the plug leans against the wall without occupying the room. However, this kind of wall plug (e.g. from TW 196786) is made by plastic injection molding so that the electric cable 23 and the blades 21 have to be placed in a mould for forming. Accordingly, the production efficiency is low and the price is high. The most important is that the main body 2 has to be made together with the electric cable 23 so that the plug has a lower strength. Moreover, it's not easy to pull the wall plug out of the wall socket because the holding surface of the fingers is too small. Therefore, an additional pull ring 24 has to be installed for the fingers to pull it out of the wall socket. These are for example from TW 306687 and 383929. When the common plugs are electrically loaded, a high temperature will be created so that the plug body will be slightly softened. The arrangement of the pull ring 24 will increase the concentration of the pulling force on a certain point. Accordingly, the inside of the wall plug will easily cause a short circuit or an interruption, thereby damaging the wall plug.

Referring to FIG. 3, another manufacturing method of the conventional wall plug is shown. The plug body 25 consists of an upper and a lower housing 251, 252 both of which are separately formed first. After the connection of components with one another, the upper and lower housings 251, 252 are combined together by means of the high frequency or screws. The connection surface 253 of this kind of wall plug is situated in the middle of the height of the plug body. Moreover, projecting ears 26 are pivotably connected between the upper and lower housings 251, 252 at both sides of the wall plug and serve to be pulled. Accordingly, the pulling force concentrates on the connection surface 253 of the upper and lower housings 251, 252 so that the plug body 25 is easily broken off, the service life is shortened and the wear is increased.

Furthermore, no matter which kind of the above-mentioned plugs is used, the color and the design can't be fully varied due to the restriction of the basic configuration of the upper and lower housings so that the various designs can't be achieved.

SUMMARY OF THE INVENTION

It is a primary object of the present invention to provide a wall plug which comprises a housing and a cover both of which can be easily connected while the housing enclosed the cover so that the strength of the main body is increased and the assembly is simplified.

It is another object of the present invention to provide a wall plug in which the pulling area of the housing and the fixing members of the blades are the same body so that the strength is intensified in pulling.

It is a further object of the present invention to provide a wall plug which makes use of different colors of the housing and the cover and the appearance of the cover on the surface of the housing to achieve the various designs of the whole body.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
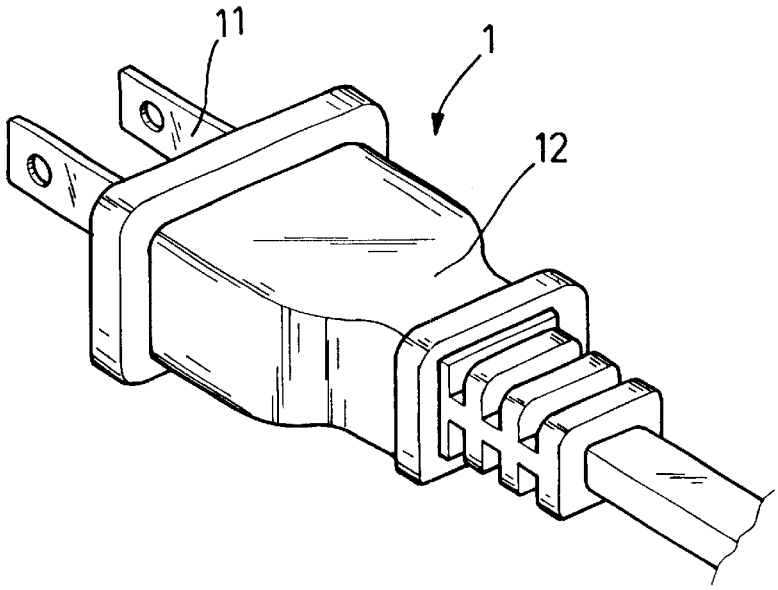
FIG. 1 PRIOR ART
FIG. 1 is a perspective view of a conventional plug.
Figure 2:
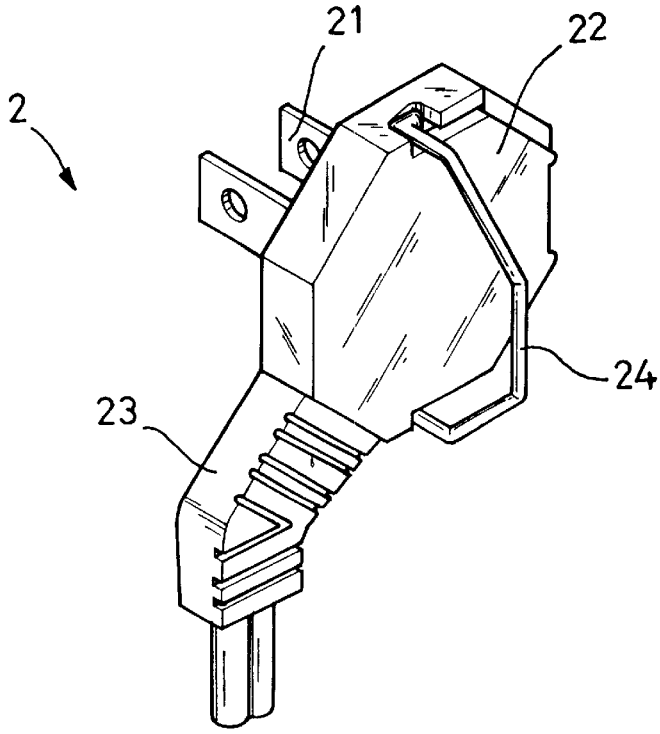
FIG. 2 PRIOR ART
FIG. 2 is a perspective view of another conventional plug.
Figure 3:
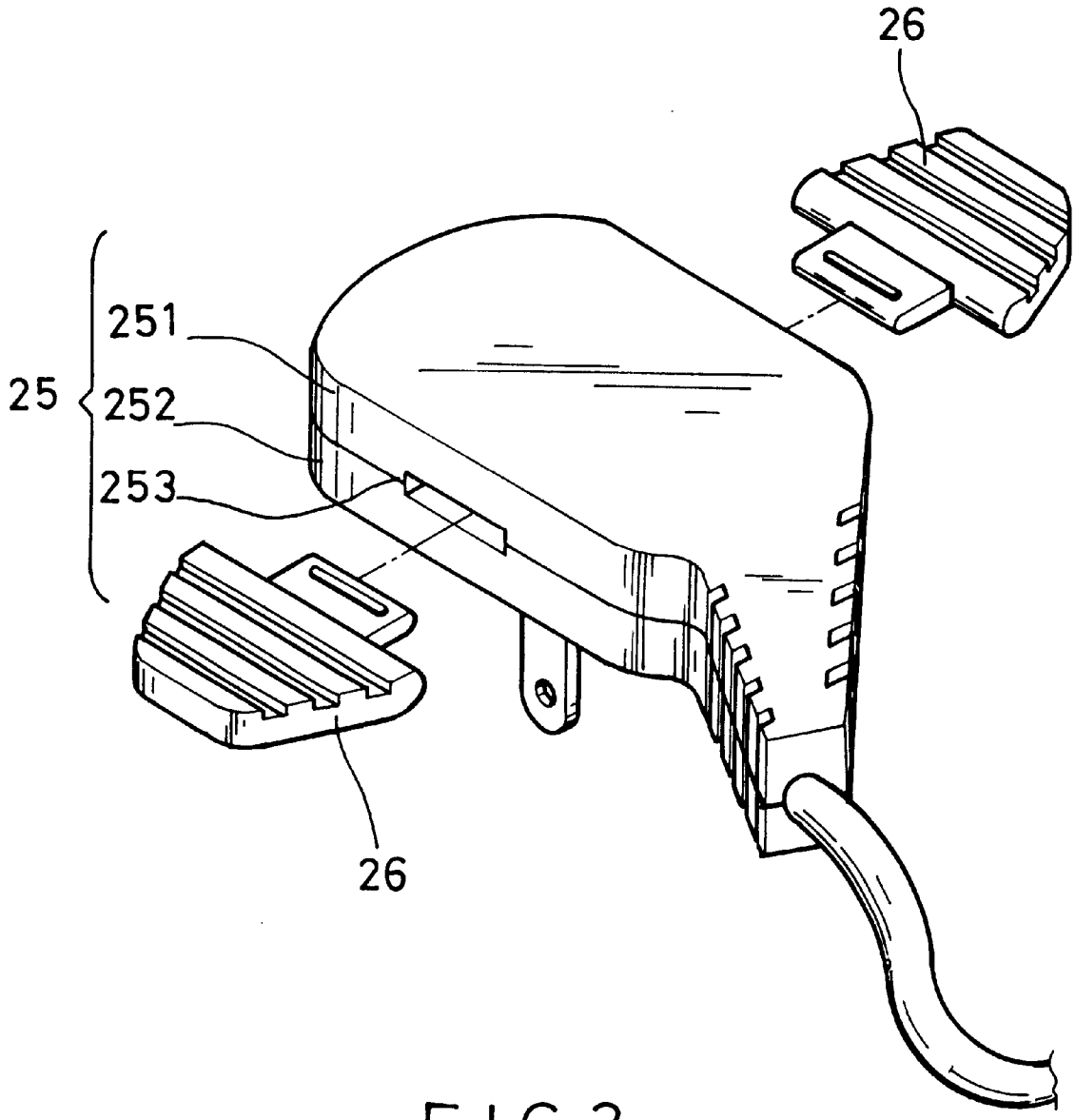
FIG. 3 PRIOR ART
FIG. 3 is a perspective view of a further conventional plug.
Figure 4:
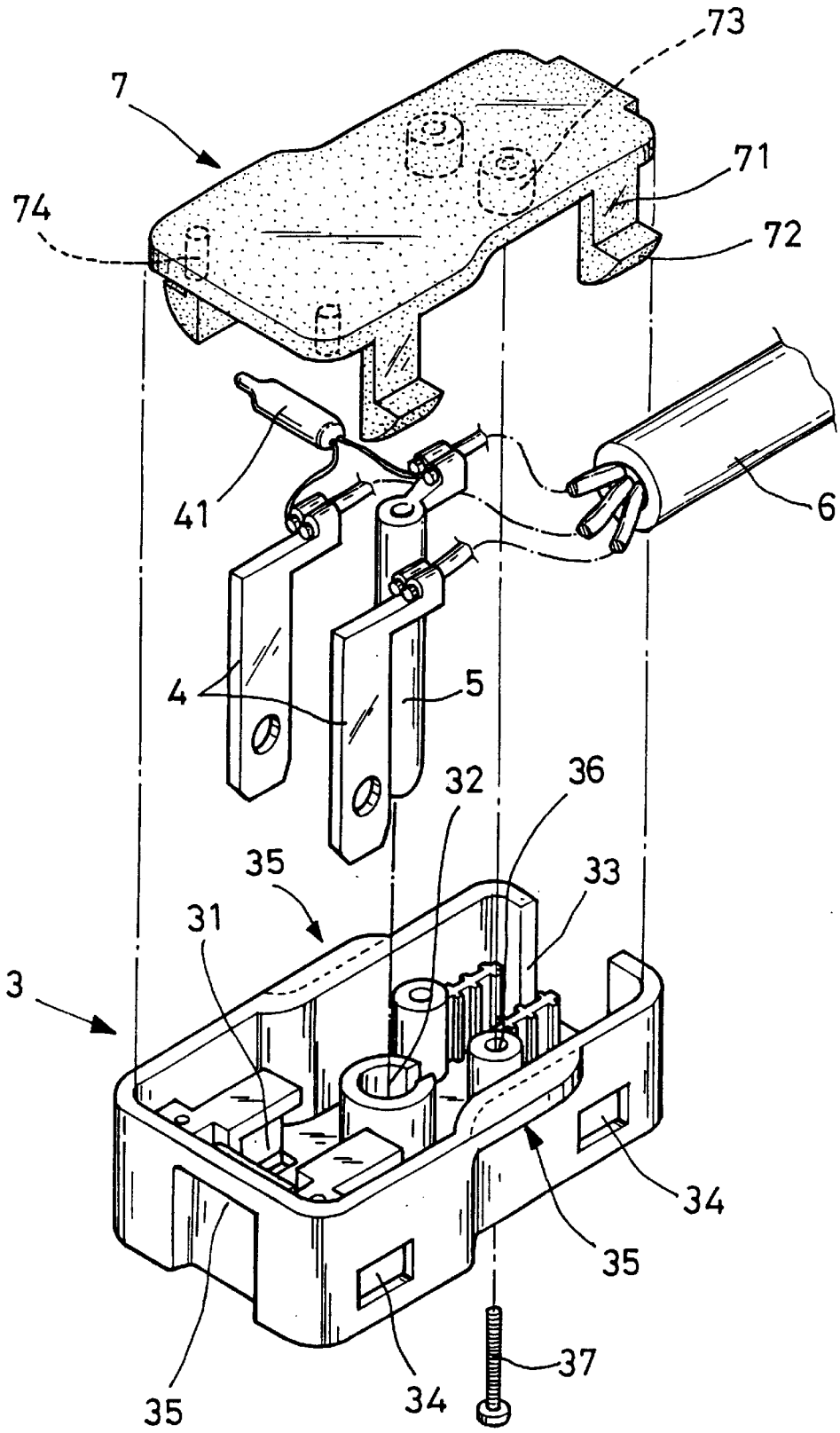
FIG. 4 is a perspective exploded view of an applicable embodiment of the present invention.
Figure 5:
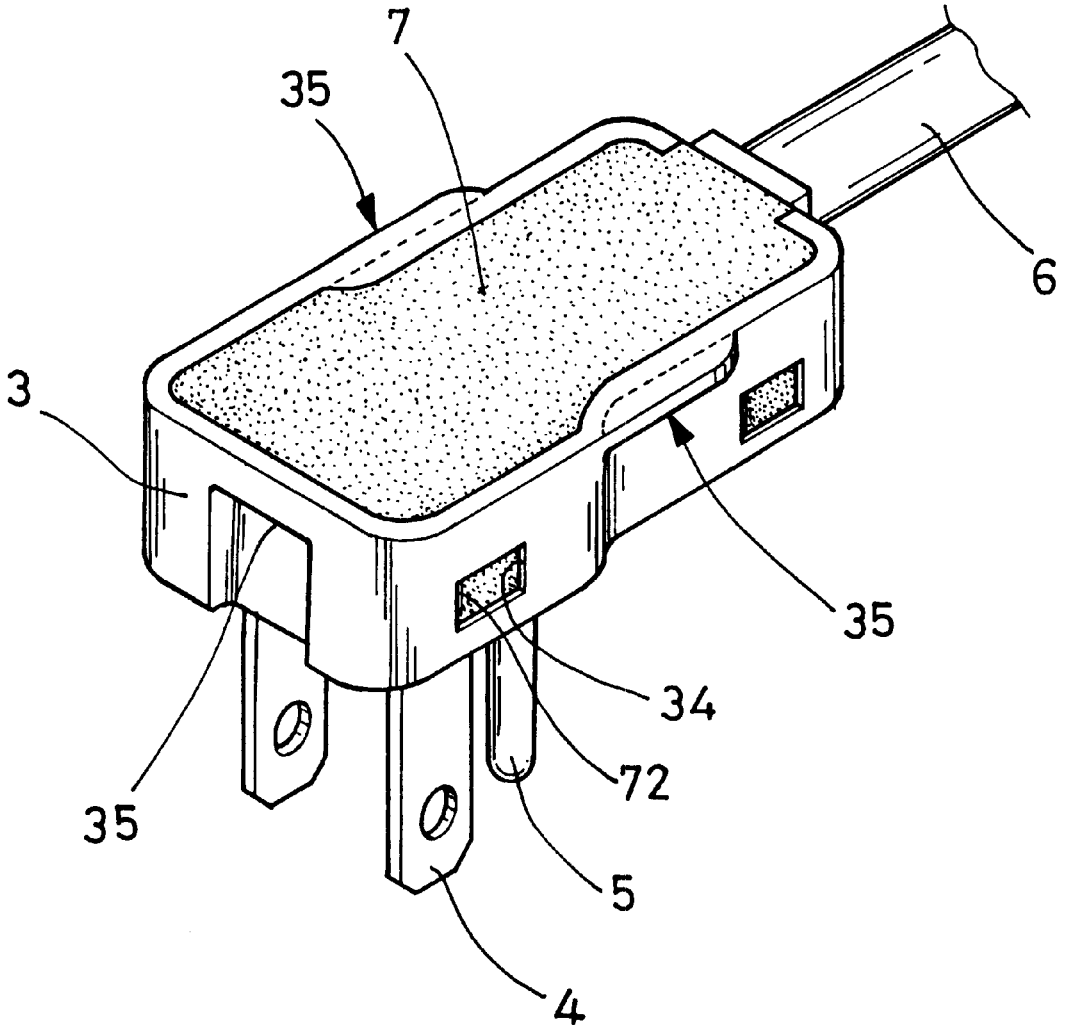
FIG. 5 is a perspective view of the applicable embodiment of the present invention.

First of all, referring to FIGS. 4 through 7, the wall plug of the present invention mainly includes a housing 3 and a cover 7.

The housing 3 has an upward opening, two fixing members 31, 32 inside thereof for receiving two blades 4 and a grounding prong 5 and a U-shaped cut 33 at the rear end thereof for fixing an electric cable 6.

The cover 7 is combined with the housing 3 to form a complete plug.

The housing 3 has the full height of the plug body and includes concave surfaces 35 at the outer side thereof.

The cover 7 is engaged into the opening of the housing 3 and fixed therein so that the housing 3 encloses the cover 7.

The cover 7 can be combined with the housing 3 through the high-frequency welding process. Alternatively, the sides of the housing 3 are provided with several locating holes 34 (see FIG. 4) while the cover 7 contains several extension legs 71 each of which includes a drop-in hook 72 at the bottom end thereof which is engaged in the locating hole 34 for a hook type connection.

The cover 7 includes a plurality of locating posts 73 at the bottom end thereof while the housing 3 contains receiving members 36 corresponding to the locating posts 73. Through these two elements, the cover 7 can be exactly mounted on the opening surface of the housing 3. Moreover, screws 37 are screwed in the receiving members 36 and the locating post 73 so that the housing 3 and the cover 7 are stably connected. In addition, the receiving members 36 serve to separate the positive and negative cords in order to ensure no short circuit inside. The cover 7 includes a pair of blocking members 74 extending downwardly therefrom. The blocking members are disposed in correspondence with side portions of the fixing members 31 to trap the upper portion of respective blades 4 therebetween.

Figure 6:
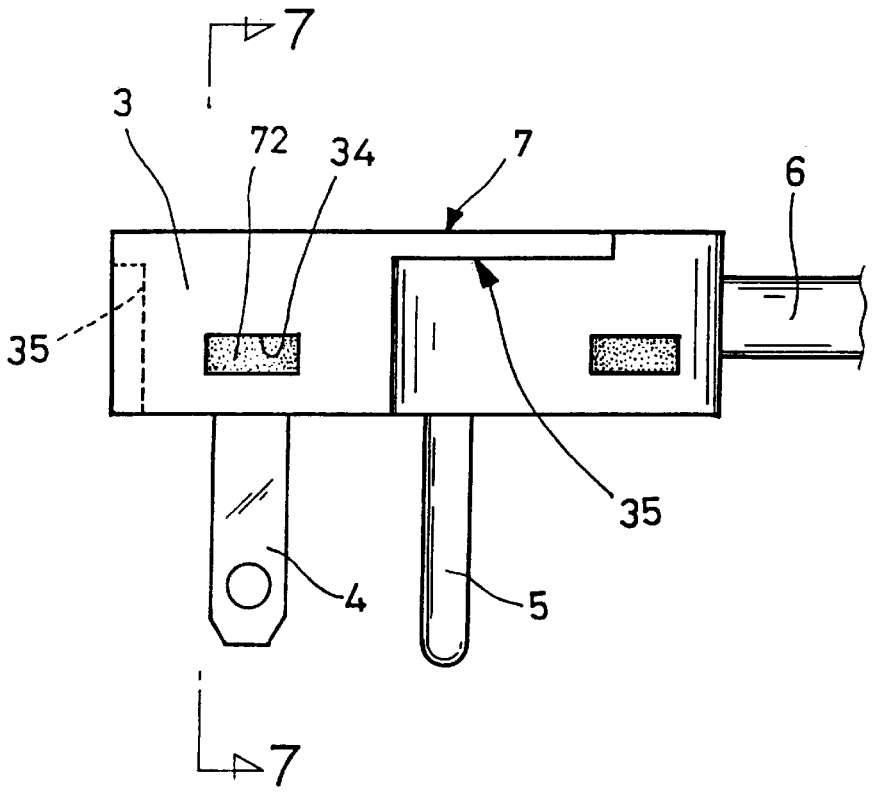
FIG. 6 is a side view of the applicable embodiment of the present invention.
Figure 7:
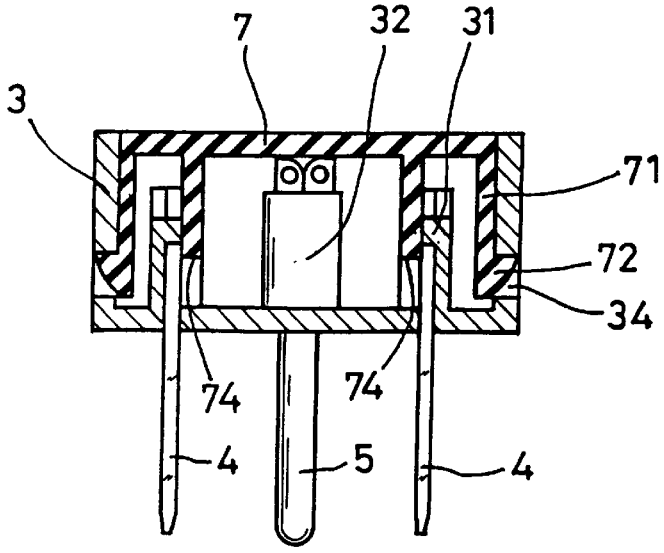
FIG. 7 is a sectional view taken along the line I—I of FIG. 6.
Figure 8:
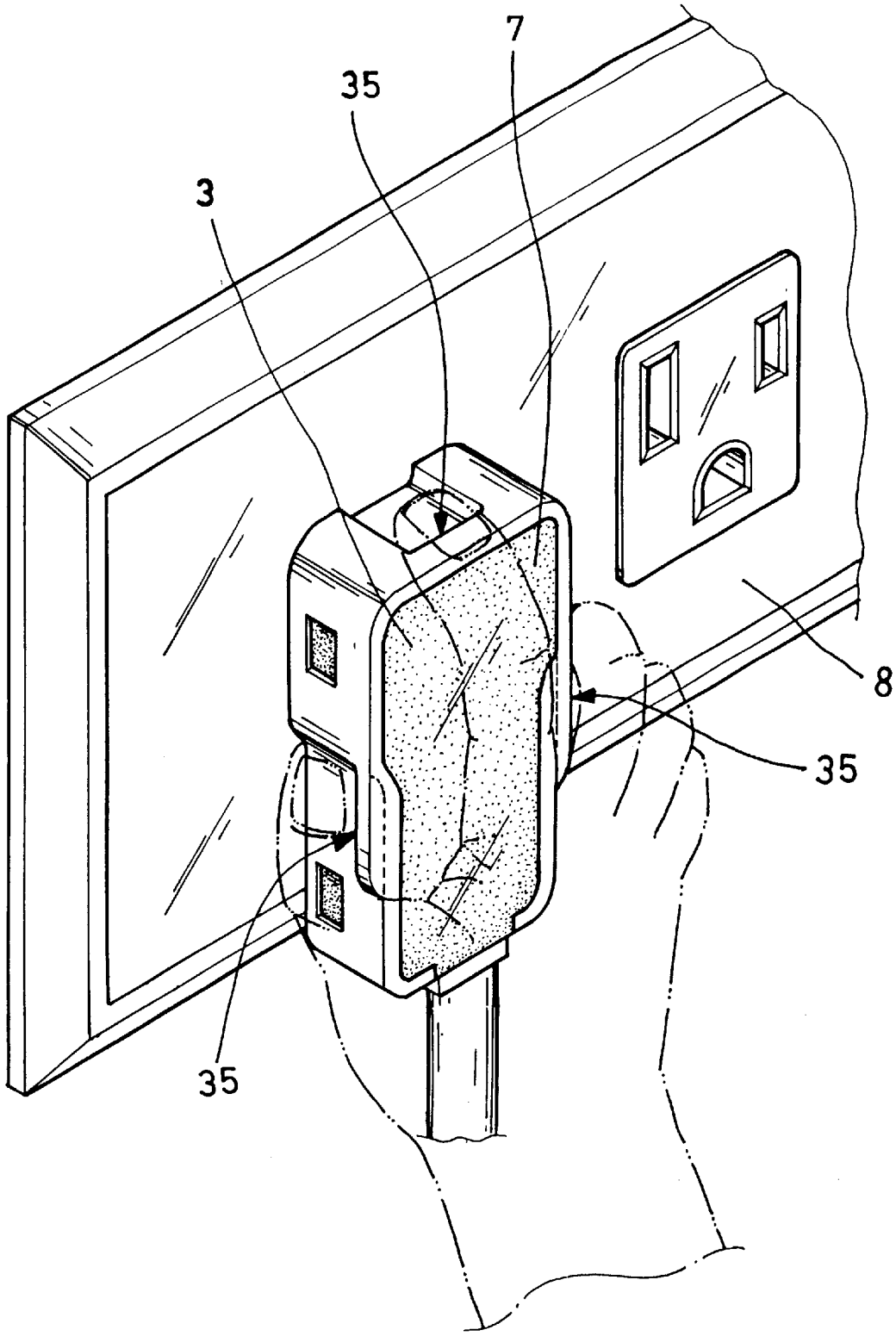
FIG. 8 is a perspective view of the present invention applied to the wall socket.

Based on the aforementioned, further descriptions are given as follows to summarize the improved effects of the present invention:

1. Unlike the conventional one with upper and lower covers, the present invention make use of the housing 3 with full height of the plug so that the whole strength is increased. As shown in FIGS. 6 and 7, the concave surfaces 35 made with the housing 3 in a body facilitate the pull of the wall plug out of the wall socket. The blades 4 and the grounding prong 5 are fixed in the fixing members 31, 32 at the inner bottom of the housing 3. Consequently, when the fingers pull the wall plug out of the wall socket, the pulling force can be exerted on the concave surfaces 35. Meanwhile, the blades 4 and the grounding prong 5 are connected with the housing 3 in a body so that the wall plug can be easily removed from the wall socket 8 and the whole body won't be deformed, the service life can be prolonged and the safety can be ensured.
2. The color of the cover 7 can be different from that of the housing 3. The top surface of the cover 7 and the lower drop-in hooks 72 appear on the surface of the housing 3 so that a dual-color is in crossed form. In addition, a neon lamp 41 (see FIG. 4) is installed inside of the wall plug and the cover 7 can be made of translucent material (e.g. red translucent plate). When the wall plug is connected in the wall socket 8, a red light will show on the surface of the whole cover 7. Accordingly, the whole body can be aesthetically improved and the design can be varied.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A wall plug comprising:

a pair of blades and a grounding prong respectively coupled to a plurality of conductors of an electrical cable;

a housing having a perimeter wall extending between a bottom wall of said housing and an open upper end thereof to define a full height of said wall plug, said housing having a cavity formed therein and in open communication with said open end, said bottom wall having a pair of blade openings formed therethrough for respectively receiving said pair of blades therein and a grounding prong opening for receiving said grounding prong therein, said bottom wall having a pair of first fixing members respectively formed adjacent said pair of blade openings and adapted for respectively encompassing corresponding upper portions of said blades to secure said blades to said housing, said bottom wall having a second fixing member at least partially circumscribing said grounding prong opening for engagement of said grounding prong, said perimeter wall having a U-shaped opening formed therethrough for passage of said electrical cable from said cavity, said perimeter wall having a plurality of locating holes formed therethrough and at least a pair of concave recesses formed therein on opposing sides of said housing, said perimeter wall having at least a pair of flanged portions disposed adjacent said open upper end of said housing in correspondence with said at least a pair of concave recesses to provide gripping surfaces for a user's fingers to exert a pulling force on said wall plug; and a cover engaged in said housing to form a closure for said open upper end, said cover having a plurality of extension legs extending therefrom and respectively disposed in correspondence with said plurality of locating holes, each of said extension legs having a hook formed on a distal end thereof for engagement with a respective one of said locating holes, said cover including a pair of blocking members extending therefrom, each of said blocking members being disposed in correspondence with a side portion of a respective one of said first fixing members to trap said upper portion of a corresponding blade therebetween.

2. The wall plug as recited in claim 1, further comprising a pilot lamp coupled between a pair of said plurality of conductors, said cover being formed of a light transmissive material for visualization of illumination of said pilot light.

* * * * *